United States Patent [19]

Heitkamp

[11] 4,439,063

[45] Mar. 27, 1984

[54] HYDRAULIC CONTROL MEANS

[75] Inventor: Herbert Heitkamp, Werne, Fed. Rep. of Germany

[73] Assignee: Gewerkschaft Eisenhutte Westfalia, Fed. Rep. of Germany

[21] Appl. No.: 263,381

[22] Filed: May 13, 1981

[30] Foreign Application Priority Data

May 21, 1980 [DE] Fed. Rep. of Germany ..... 3019374

[51] Int. Cl.[3] ..... E21D 9/06; F16D 31/02

[52] U.S. Cl. ..... 405/145; 60/486

[58] Field of Search ..... 405/140, 141, 145, 302; 91/170 MP, 522, 523, 526, 527, 530, 531; 60/421, 427, 429, 486

[56] References Cited

U.S. PATENT DOCUMENTS

| | | | |
|---|---|---|---|
| 2,366,388 | 1/1945 | Crosby | 60/486 X |
| 2,960,828 | 11/1960 | Gould | 60/486 X |
| 3,178,888 | 4/1965 | Hampton | 60/486 X |
| 3,486,333 | 12/1969 | Thomas | 60/486 X |
| 3,922,855 | 12/1975 | Bridwell et al. | 60/486 X |
| 4,095,436 | 6/1978 | Heitkamp et al. | 405/145 X |
| 4,191,498 | 3/1980 | Weirich et al. | 405/302 |

*Primary Examiner*—David H. Corbin
*Assistant Examiner*—Nancy J. Stodola
*Attorney, Agent, or Firm*—Neil F. Markva

[57] ABSTRACT

A tunnel knife shield has a support frame, and a plurality of knife positioned side-by-side on the support frame. Each of the knives is associated with a double-acting hydraulic ram, the rams being used for advancing the knives, and for causing the support frame to follow up the advance of the knives. Hydraulic control means are provided for controlling the extension and retraction of the rams. Each ram has first and second working chambers, pressurization of which is effective to extend and retract that ram. The hydraulic control means comprises a plurality of control valves, each of which is associated with a respective hydraulic ram. Each control valve is provided with a first input constituted by a separate first hydraulic line. Each control valve is also provided with a second input, which is constituted by a common second hydraulic line. The common second hydraulic line is fed with hydraulic fluid by all of the first hydraulic lines. Thus, when a given control valve is in a first operating position, the first working chamber of the associated ram is connected to the common second hydraulic line; and, when that valve is in a second operating position, the second working chamber of that ram is connected to the first hydraulic line associated with the control valve.

23 Claims, 4 Drawing Figures

HYDRAULIC CONTROL MEANS

BACKGROUND TO THE INVENTION

This invention relates to hydraulic control means for controlling the advance rams of a tunnelling knife shield.

Knife shields are used for forming tunnels, drifts, mine galleries, adits, trenches, and other elongate excavations. Typically, a knife shield has a plurality of knives (planks) positioned side-by-side, and supported on a common support frame. A double-acting hydraulic ram is positioned between each of the rams and the support frame. The knives are advanced, either singly or in groups, by extending their rams, the remaining, stationary knives forming (with the support frame) an abutment for such advance movement owing to their frictional contact with the surrounding earth of the tunnel walls. When all the knives have been advanced, the support frame is advanced, in a follow-up step, by simultaneously retracting all the rams, the frictional contact between the knives and the surrounding earth providing an abutment for this movement.

In order to prevent the support frame from assuming undesired inclined positions, of from tilting, during its follow-up movement (and to ensure that all the rams are provided with substantially the same amount of hydraulic fluid), it is known to provide such a knife shield with control means for synchronizing the retraction of the rams. For this purpose, flow-regulation valves are fitted in the hydraulic lines leading to the ram working chambers. Unfortunately, the flow-regulation valves available for this purpose can be used only for working pressures up to about 300 bars. At pressures higher than about 300 bars, these flow-regulation valves are subjected to intolerably heavy wear, so that their use cannot be entertained. On the other hand, knife shields usually operate at considerably higher hydraulic working pressures, so that sufficiently large forces are available for advancing the knives rapidly.

DE-OS No. 2 546 755 discloses hydraulic control means for a knife shield, the control means having a hydraulic pressure-supply system comprising a plurality of pumps. Each of the pumps is powered by a separate motor, and the pump outlets are connected to the knife advance rams by way of flow-dividing valves. Unfortunately, the provision of several pumps and motors involves a relatively large capital investment.

The aim of the invention is to provide relatively cheap hydraulic control means for a knife shield, which control means can effect synchronous control of the knife advance rams without the use of flow-regulation valves, and which can operate at high working pressures of 500 bars or more.

SUMMARY OF THE INVENTION

The present invention provides hydraulic control means for controlling the advance rams of a tunnelling knife shield of the type having a plurality of knives positioned side-by-side on a support frame. The rams are positioned between the knives and the support frame, and each ram has first and second working chambers of which is effective to extend and retract that ram. The hydraulic control means have a plurality of control valves, each of which is associated with a respective hydraulic ram. Each control valve includes a first, low-pressure input and a second, high-pressure input. Each of the first, low-pressure inputs comprises a separate second, low-pressure hydraulic line. Each of the second inputs is connected to a common second hydraulic line. The common second hydraulic line is connected to a plurality of the first hydraulic lines, whereby, when a given control valve is in a first operating position, the first working chamber of the associated ram is connected to the common second hydraulic line, and, when that valve is in a second operating position, the second working chamber of that ram is connected to the first hydraulic line associated with that control valve.

Advantageously, the hydraulic control means further comprises a multi-flow pump for supplying pressurized hydraulic fluid to all of the first hydraulic. lines, the first hydraulic lines being supplied with equal amounts of pressurized hydraulic fluid via separate pump outlets.

With this form of hydraulic control means, it is possible to advance the knives at a relatively high speed, and to cause the support frame to follow-up at a low speed. Thus, synchronous control can be effected without the use of flow-regulation valves, since all the second working chambers can be charged with the same amount of hydraulic fluid from the multi-flow pump. Sufficiently, large forces are available for advancing the knives, since high pump pressures (for example 500 bars or more) can be achieved using such a pump.

Preferably, each of the control valves has a third operating position, in which the second working chamber of the associated ram is connected to the second hydraulic line. It is, therefore, possible to retract the knives rapidly when required, for example in the event of an obstacle being in the path of a knife or knives.

Advantageously, the pump is a pump having a plurality of axially-spaced cylinder blocks associated with a common pump shaft, each of the cylinder blocks having a plurality of radially-disposed piston-and-cylinder units. Preferably, the output of each piston-and-cylinder unit of the pump is connected to a respective line. The number of pump outputs (piston-and-cylinder units) thus corresponds to the number of rams.

Each of the first hydraulic lines may be provided with a branch line and all the branch lines are directed to the common second hydraulic line. Advantageously, a further branch line connects the branch lines to the common second hydraulic line, and a by-pass line leads from the further branch line to a return line which returns hydraulic fluid to a tank at the input side of the pump. Preferably, the by-pass line is provided with a pressure-controlled switching valve which opens the by-pass line to the return line when the pressure of hydraulic fluid in the common second hydraulic line reaches a predetermined level; and the switching valve is actuated by a pressure switch connected to the second hydraulic line.

Advantageously, each of the control valves is a manually-operated or remotely-controlled 5/4-way control valve. Each of the control valves may have a fourth "neutral" position, in which the associated ram is hydraulically locked.

Preferably, the control means further comprises a respective pressure-relief valve associated with each of the rams, the pressure-relief valves being adapted to limit the pressure in the second working chambers of the rams. This arrangement ensures that the support frame does not slide back into the shield when several knives are advanced simultaneously at the inside of a curve. On the other hand, the pressure-relief valves permit the control movement necessary for controlling the direction of tunnel advance.

In one preferred embodiment, the rams of the knife shield are divided into a plurality of groups, the rams of each group being associated with the piston-and-cylinder units of a respective cylinder block of the radial-piston pump.

This invention also provides hydraulic control means for controlling the advance rams of a tunnelling knife shield of the type having a plurality of knives positioned side-by-side on a support frame, the rams being positioned between the knives and the support frame, and each ram having first and second working chambers pressurization of which is effective to extend and retract that ram. The hydraulic control means includes a plurality of control valves, each of which is associated with a respective hydraulic ram, wherein each control valve is provided with a first input and a second input. Each of the first inputs comprises a separate first hydraulic line, and each of the second inputs is connected to one of a plurality of common second hydraulic lines. Each common second hydraulic line is connected to a plurality of the first hydraulic lines, whereby, when a given control valve is in a first operating position, the first working chamber of the associated ram is connected to the associated common second hydraulic line, and, when that valve is in a second operating position, the second working chamber of that ram is connected to the first hydraulic line associated with that control valve.

BRIEF DESCRIPTION OF THE DRAWINGS

A tunnel knife shield incorporating hydraulic control means constructed in accordance with the invention, will now be described, by way of example, with reference to the accompanying drawings, in which.

DESCRIPTION OF PREFERRED EMBODIMENTS

Figure 1:
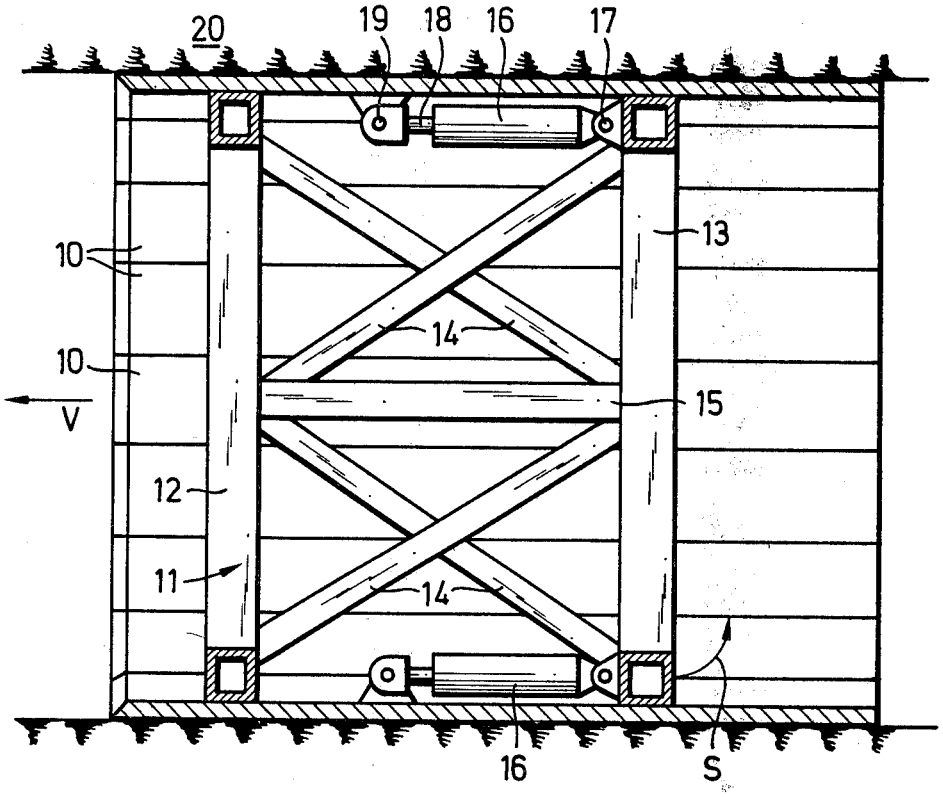
FIG. 1 is a diagrammatic longitudinal cross-section taken through the knife shield.
Figures 3, 4:
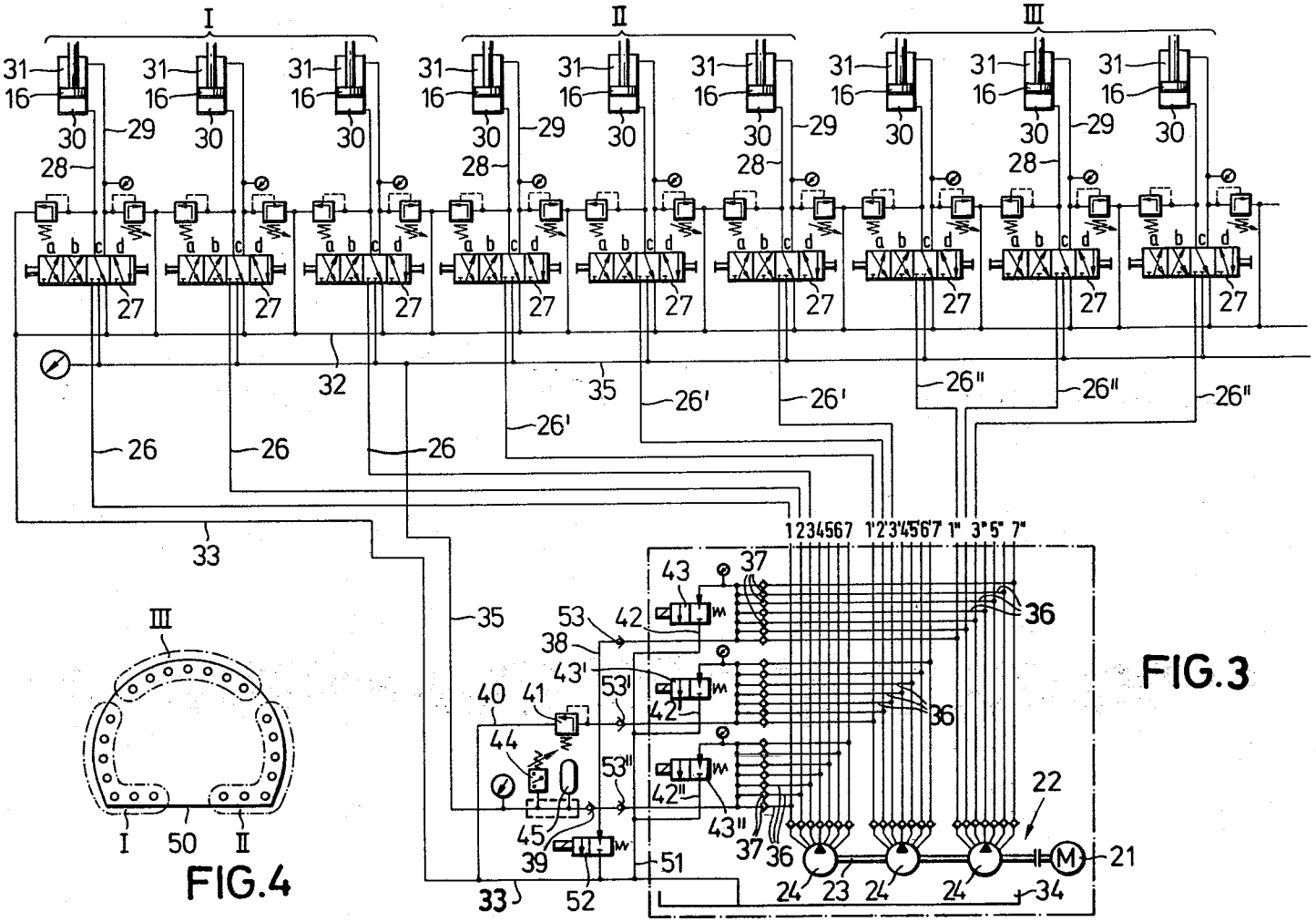
FIG. 3 is a circuit diagram showing a second form of hydraulic control means for controlling the knives of the knife shield.
FIG. 4 is a schematic transverse cross-section taken through the knife shield.

Referring to the drawings, FIG. 1 shows a knife shield for use in tunnelling, the knife shield having a plurality of knives (planks) 10 which are mounted in a side-by-side parallel relationship so as to define a cylindrical shell having a "horseshoe" shaped cross-section 50 (see FIG. 4). The shell forms a protective shield within which the men and machines carrying out the tunnelling operations are protected. The shell may be open at the bottom (as shown in FIG. 4), or it may form a closed, cylindrical jacket. The knives 10 are supported and guided upon a support frame 11 having two axially-spaced frame members 12 and 13 of box-girder construction. The frame members 12 and 13 are rigidly interconnected by diagonal and longitudinal struts 14 and 15, respectively.

Each of the knives 10 is provided with a double-acting hydraulic advance ram 16 for advancing that knife. The cylinders of the rams 16 are pivotally connected, by means of pivot joints 17, to the frame member 13; and the piston rods 18 of the rams are pivotally connected, by means of pivot joints 19, to the knives 10. The rams 16 can be charged with pressurized hydraulic fluid, either snugly or in groups, so as to extend their piston rods 18. As a given ram 16 is extended, its cylinder is braced against the frame member 13 of the frame 11, so that the knife 10 associated with that ram is advanced in the direction of the arrow V. The frame 11 forms an abutment for this knife advance movement, because it is held stationary owing to the frictional contact between the other knives 10 and the earth 20 of the surrounding tunnel wall. As soon as all the knives 10 have been advanced, the support frame is advanced, in a follow-up step, by simultaneously retracting all the rams 16. The frictional contact between the knives 10 and the earth 20 provides an abutment for the advance movement of the frame 11.

Figure 2:
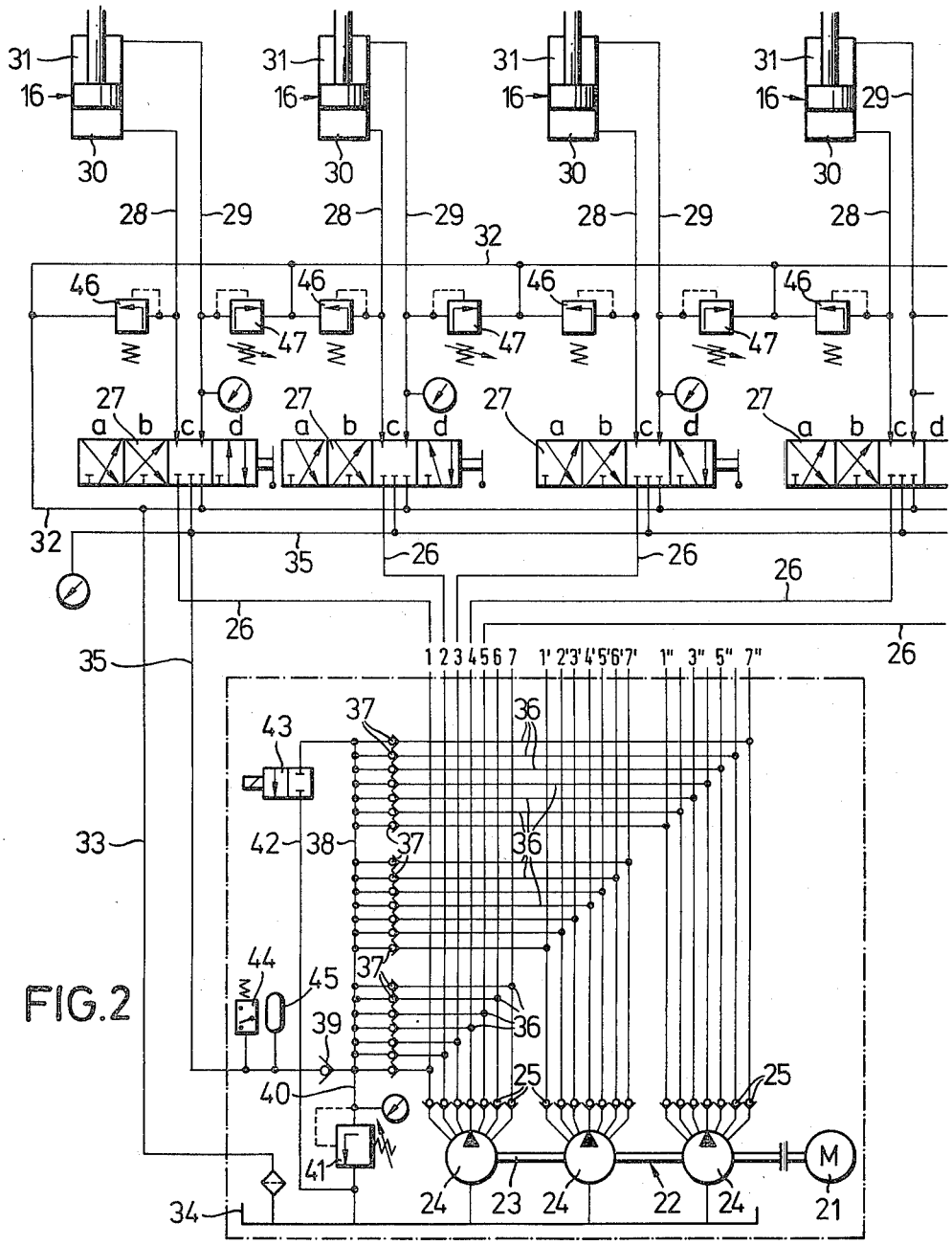
FIG. 2 is a circuit diagram showing a first form of hydraulic control means for controlling the knives of the knife shield.

FIG. 2 illustrates hydraulic control means for controlling the rams 16 of the knife shield described above. This figure shows how the hydraulic control means controls only four rams 16, but it will be appreciated that all the rams of the knife shield are controlled in a similar fashion. The hydraulic control means include a pressurized hydraulic fluid supply system constituted by a radial piston pump 22, which is powered by a motor 21. Alternatively, the pressurized hydraulic fluid supply system may be constituted by any other type of multi-piston pump, or by any type of multi-flow pump.

The radial piston pump 22 has three cylinder blocks 24, which are mounted on a common pump shaft 23. Each cylinder block 24 has seven separate outlets for pressurized hydraulic fluid, and each cylinder block has a multiple of seven (usually seven or fourteen) piston-and-cylinder units arranged radially about the pump shaft 23. Where there are seven piston-and-cylinder units in each cylinder block 24, each unit supplies one of the outlets; and where there are fourteen such units, two units supply each of the outlets. Thus, the pump 22 has twenty-one outlets, this number corresponding to the number of the rams 16. The outlets are connected, via respective non-return valves 25, to lines 1 to 7, 1' to 7' and 1'' to 7''. Each of the lines 1 to 7, 1' to 7' and 1'' to 7'' is connected, via a respective connecting line 26, to a first inlet of a respective control valve 27, each of which is associated with one of the rams 16. Each of the control valves 27 is a 5/4-way control valve, which may be actuated either manually or automatically from a remote position. The two outlets of each control valve 27 are connected, via lines 28 and 29, to the working chambers 30 and 31 respectively of the associated ram 16. The working chambers 30 are cylindrical working chambers, and the working chambers 31 are annular working chambers.

The control valves 27 also have second inlets and third inlets. All of the second inlets of the control valves 27 are connected to a common return line 32,33 which leads to a tank 34 containing the hydraulic fluid which is supplied to the inlet of the pump 22. All the third inlets of the control valves 27 are connected to a common supply line 35. The supply line 35 is provided with pressurized hydraulic fluid by all the lines 1 to 7, 1' to 7' and 1'' to 7'', via respective branch lines 36 leading from the lines 26. Each branch line 36 is provided with a respective non-return valve 37. The branch lines 36 are connected to the common supply line 35 by a further branch line 38 and a non-return valve 39. The branch line 38 is also connected to the tank 34 by a line 40 provided with a pressure-relief valve 41. The pressure-relief valve 41 is set, for example, to a maximum working pressure of 550 bars. A by-pass line 42 is provided in parallel with the branch line 38, the line 42 being provided with a pressure-controlled switching valve 43. Preferably, the switching valve 43 is an electromagnetic switching valve, which is actuated by a pressure switch 44 connected to the common supply line 35. In addition, a reservoir 45 is connected to the common supply line 35, the reservoir serving to store pressurized hydraulic fluid temporarily when the pump 22 is stopped for a short time.

Thus, the pump 22 delivers equal amounts of pressurized hydraulic fluid into each of the lines 1 to 7, 1' to 7' and 1'' to 7'', each of which is connected to the respective control valve 27 and to the common supply line 35. When the maximum working pressure (say 550 bars) is exceeded, the switching valve 43 is opened by the pressure switch 44, so that hydraulic fluid is returned, at a low pressure, to the tank 34 via the line 42. When the switching valve 43 is closed, pressurized hydraulic fluid is supplied to the common supply line 35 as well as to the lines 1 to 7, 1' to 7' and 1'' to 7''. As mentioned above, the reservoir 45 stores hydraulic fluid if the pump 22 is stopped temporarily. The reservoir 45 also smooths out pressure fluctuations, and offsets any slight leakage losses.

Each of the control valves 27 has four operating positions a, b, c and d. In the operating position c (see FIG. 2), the lines 28 and 29 leading to the ram working chambers 30 and 31 are blocked, so that the rams 16 are hydraulically locked. The two lines 28 and 29 of each ram 16 are each connected to the common return line 32,33 via respective pressure-relief valves 46 and 47. These pressure-relief valves 46 and 47 are effective to relieve excess pressure in the ram working chambers 30 and 31.

In order to pressurize a given ram working chamber 30, so as to advance the associated knife 10, the respective control valve 27 is brought into the operating position d. In this position d, the associated line 28 is connected to the common supply line 35, while the associated line 29 is connected to the common return line 32,33. Consequently, the associated knife 10 is advanced rapidly under the influence of the high pressure or large volume of the hydraulic fluid supplied to the respective ram working chamber 30 from the common supply line 35.

After all the knives 10 have been rapidly advanced in this manner, the support frame 11 is advanced in a follow-up step. For this purpose, all the control valves are brought into the operating position b. In this position b, the ram working chambers 30 are connected to the common return line 32,33 via the lines 28 and the control valves 27; while the ram working chambers 31 are connected to the associated lines 1 to 7 1' to 7' and 1'' to 7'' via the lines 29 and the control valves 27. Thus, all the rams 16 are retracted simultaneously and at the same rate, as all the working chambers 31 are supplied with equal amounts of hydraulic fluid (that is to say all the chambers 31 are provided with hydraulic fluid at the same pressure).

If a given control valve is brought into the operating position a, the working chamber 31 of the associated ram 16 is connected to the common supply line 35, whereas its ram working chamber 30 is connected to the return line 32,33. In this case, the associated knife 10 is rapidly retracted. This operating position a is used when it is necessary to retract a knife (or a group of knives) 10 in a rapid manner, without advancing the frame 11.

The hydraulic control means described above with reference to FIG. 2 is such that, with the control valves 27 in the operating positions a or d, all the pump outlet lines 1 to 7, 1' to 7' and 1'' to 7'' are fed into the common supply line 35; whereas, in the operating position c, the pump outlet lines are fed back to the tank, via the line 42.

FIG. 3 shows a modified form of hydraulic control means for controlling the hydraulic rams 16 of the knife shield described above. As the control means of FIG. 3 is similar to that of FIG. 2, like reference numerals have been used for like parts. The rams 16 of the shield are controlled in three groups I, II and III, each group having seven rams disposed adjacent to one another along the periphery of the shield (see FIG. 4). For the sake of simplicity, FIG. 3 shows how the hydraulic control means controls only three rams 16 of each group I, II and III. As shown in FIG. 3, the pump outlet lines 1 to 7 of a first cylinder block 24 of the pump 22 are connected, via lines 26, to the control valves 27 associated with the rams 16 of group I. Similarly, the pump outlet lines 1' to 7' are connected, via lines 26', to the control valves 27 associated with the rams 16 of group II; and the pump outlet lines 1'' to 7'' are connected, via lines 26'', to the control valves associated with the rams 16 of group III. Thus, during the follow-up movement of the support frame 11, the rams 16 of the three groups I, II and III are supplied with pressurized hydraulic fluid from the pump outlet lines 1 to 7, 1' to 7' and 1'' to 7'' respectively, so what is known as a "three-point" control system results.

As with the control means of FIG. 2, all the pump outlet lines 1 to 7, 1' to 7' and 1'' to 7'' have branch lines 36, which feed pressurized hydraulic fluid into the common supply line 35, via the further branch line 38. Thus, the rams 16 can be rapidly extended (or retracted) either individually or in groups, under the high-pressure conditions associated with the common supply line 35. Each group of pump outlet lines 1 to 7, 1' to 7' and 1'' to 7'' has a respective pressure-controlled switching valve 43,43' and 43'' associated therewith. As described above with reference to FIG. 2, each of the switching valves 43,43' and 43'' is actuated by the pressure switch 44 connected to the common supply line 35. However, the control arrangement of FIG. 3 has respective by-pass lines 42, 42' and 42'' associated with the three groups of pump outlet lines 1 to 7, 1' to 7' and 1'' to 7'', and the switching valves 43, 43' and 43'' are provided in these by-pass lines. The outlets of the lines 42, 42' and 42'' lead to a common return line 51, which leads to the tank 34. A control valve 52 is provided between the branch line 38 and the return line 33. The three collector lines (which combine the groups of pump outlet lines 1 to 7, 1' to 7' and 1'' to 7'') are connected to the branch line 38 (and to the common supply line 35), via respective non-return valves 53, 53' and 53''.

If all the control valves are brought into the position b, so as to cause the follow-up movement of the support frame 11, the pump 22 delivers pressurized hydraulic fluid exclusively to the ram working chambers 31, since the switching valves 43, 43' and 43'' are closed, and the path through the common supply line 35 is closed.

If a given control valve 27 is brought into the operating position d, the working chamber 30 of the associated ram 16 is connected to the common supply line 35, and the working chamber 31 is connected to the return line 32,33. Thus, that ram 16 is extended rapidly. In order to retract a given ram 16 rapidly, the associated control valve 27 is brought into the operating position a, in which the ram working chamber 31 is connected to the common supply line 35, and the ram working chamber 30 is connected to the return line 32,33. For both rapid extension and retraction of a given ram 16, the associated line 26, 26' or 26'' is blocked by the associated control valve 27.

If the control valves 27 are brought into the blocking position (operating position c), the switching valves 43, 43' and 43'' are opened, owing to the pressure rise in the common supply line 35. Consequently, the rams 16 are hydraulically locked, and the pump output is returned to the tank 34 via the valves 43, 43' and 43''.

It will be appreciated that the hydraulic control means of FIG. 3 could be used with knife shields having different cross-sections (for example circular) than that shown in FIG. 4. For a knife shield having a circular cross-section, the knife advance rams could be divided into three or four groups, each of which would be associated with a different set of pump outlet lines. It is also possible to replace the common supply line by two or more collector supply lines, each of which is fed by a set of pump outlet lines. For example, it is possible to provide a separate collector supply line for each group of rams, a first set of pump outlet lines being connected to the first collector supply line, a second set of pump outlet lines being connected to a second collector supply line, and so on.

I claim:

1. In a tunnel knife shield having a support frame, a plurality of knives positioned side-by-side on the support frame, a plurality of double-acting hydraulic rams for advancing the knives and for causing the support frame to follow up the advance of the knives, the rams being positioned between the knives and the support frame, and each ram having first and second working chambers pressurization of which is effective to extend and retract that ram, an improved hydraulic control means for controlling the extension and retraction of the rams, the hydraulic control means comprising:

(a) a multi-flow pump and a plurality of control valves, each of which is associated with a respective hydraulic ram, (b) each control valve including a first input and a second input, (c) each of the first inputs is connected to a separate first hydraulic line, and each of the second inputs is connected to a common second hydraulic line, (d) the common second hydraulic line being connected to a plurality of the first hydraulic lines, whereby when a given control valve is in a first operating position, the first working chamber of the associated ram is connected to the common second hydraulic line, and, when that valve is in a second operating position, the second working chamber of that ram is connected to the first hydraulic line associated with that control valve, (e) the multi-flow pump supplies pressurized hydraulic fluid to all of the first hydraulic lines, the first hydraulic lines being supplied with equal amounts of pressurized hydraulic fluid via separate pump outlets.

2. Hydraulic control means according to claim 1, wherein the common second hydraulic line is connected to all the first hydraulic lines.

3. Hydraulic control means according to claim 1, wherein each of the control valves has a third operating position, in which the second working chamber of the associated ram is connected to the second hydraulic line.

4. Hydraulic control means according to claim 1, wherein each of the first hydraulic lines is provided with a branch line and all the branch lines lead to the common second hydraulic line.

5. Hydraulic control means according to claim 4, wherein a further branch line connects the branch lines to the common second hydraulic line, and a bypass line leads from the further branch line to a return line which returns hydraulic fluid to a tank at the input side of the pump.

6. Hydraulic control means according to claim 5, wherein the by-pass line includes a pressure-controlled switching valve which opens the by-pass line to the return line when the pressure of hydraulic fluid in the common second hydraulic line reaches a predetermined level.

7. Hydraulic control means according to claim 6, wherein the switching valve is actuated by a pressure switch connected to the common second hydraulic line.

8. Hydraulic control means according to claim 1, wherein the pump is a radial piston pump having a plurality of axially-spaced cylinder blocks associated with a common pump shaft, each of the cylinder blocks having a plurality of radially-disposed piston-and-cylinder units.

9. Hydraulic control means according to claim 8, wherein the output of each piston-and-cylinder unit of the pump is connected to a respective first hydraulic line.

10. Hydraulic control means according to claim 1, wherein each of the control valves is a 5/4-way control valve.

11. Hydraulic control means according to claim 1, further comprising a reservoir connected to the common second hydraulic line.

12. Hydraulic control means according to claim 1, further comprising a respective pressure-relief valves associated with each of the rams, the pressure-relief valves being adapted to limit the pressure in the second working chambers of the rams.

13. Hydraulic control means according to claim 9, wherein the rams of the knife shield are divided into a plurality of groups, the rams of each group being associated with the piston-and-cylinder units of a respective cylinder block of the radial piston pump.

14. Hydraulic control means according to claim 13, wherein the first hydraulic lines associated with each group of rams are connected to the common second hydraulic via respective branch lines and a respective further branch line.

15. Hydraulic control means according to claim 14, further comprising a respective by-pass line associated with each of the further branch lines, each by-pass line leading from the associated further branch line to a return line which returns hydraulic fluid to a tank at the input side of the radial piston pump.

16. Hydraulic control means according to claim 15, wherein each by-pass line includes a pressure-control switching valve which opens said by-pass line to the return line when the pressure of hydraulic fluid in the common second hydraulic line reaches a predetermined level.

17. Hydraulic control means according to claim 16, wherein the switching valves are actuated by a pressure switch connected to the second hydraulic line.

18. In a tunnel knife shield having a support frame, a plurality of knives positioned side-by-side on the support frame, a plurality of double-acting hydraulic rams for advancing the knives and for causing the support frame to follow up the advance of the knives, the rams being positioned between the knives and the support frame, and each ram having first and second working chambers pressurization of which is effective to extend and retract that ram, an improved hydraulic control means for controlling the extension and retraction of the rams, the hydraulic control means comprising:

(a) a multi-flow pump and a plurality of control valves, each of which is associated with a respective hydraulic ram, (b) each control valve includes a first input and a second input, (c) each of the first inputs is connected to a separate first hydraulic line, and each of the second inputs is connected to one of a plurality of common second hydraulic lines, (d) each common second hydraulic line being connected to a plurality of first hydraulic lines, whereby, when a given control valve is in a first operating position, the first working chamber of the associated ram is connected to the associated common second hydraulic line, and, when that valve is in a second operating position, the second working chamber of that ram is connected to the first hydraulic line associated with that control valve, (e) the multi-flow pump supplies pressurized hydraulic fluid to all of the first hydraulic lines, the first hydraulic lines being supplied with equal amounts of pressurized hydraulic fluid via separate pump outlets.

19. Hydraulic control means according to claim 18, wherein the rams of the knife shield are divided into a plurality of groups of rams, each of which is associated with a respective common second hydraulic line, and each common second hydraulic line is connected to all the first hydraulic lines associated with the rams of that group.

20. Hydraulic control means according to claim 19, further comprising a radial-piston pump for supplying pressurized hydraulic fluid to the first hydraulic lines, the radial piston pump having a plurality of axially-spaced cylinder blocks associated with a common pump shaft, each of the cylinder blocks having a plurality of radially-disposed piston-and-cylinder units.

21. Hydraulic control means according to claim 26, wherein each of the first hydraulic lines is connected to a respective piston-and-cylinder unit, and the piston-and-cylinder units of each cylinder block are associated with a respective common second hydraulic line.

22. A tunnel knife shield comprising:

(a) a support frame, (b) a plurality of knives positioned side-by-side on the support frame, (c) a plurality of double-acting hydraulic rams for advancing the knives and for causing the support frame to follow up the advance of the knives, (d) hydraulic control means for controlling the extension and retraction of the rams, (e) the rams being positioned between the knives and the support frame, and each ram having first and second working chambers pressurization of which is effective to extend and retract that ram, (f) the hydraulic control means having a multi-flow pump and a plurality of control valves, each of which is associated with a respective hydraulic ram, (g) each control valve including a first input and a second input, and wherein each of the first inputs is connected to a separate first hydraulic line, and each of the second inputs is connected to a common second hydraulic line, (h) the common second hydraulic line being connected to a plurality of the first hydraulic lines, whereby, when a given control valve is in a first operating position, the first working chamber of the associated ram is connected to the common second hydraulic line, and, when that valve is in a second operating position, the second working chamber of that ram is connected to the first hydraulic line associated with that control valve, (i) the multi-flow pump supplies pressurized hydraulic fluid to all of the first hydraulic lines, the first hydraulic lines being supplied with equal amounts of pressurized hydraulic fluid via separate pump outlets.

23. A knife shield according to claim 22 wherein the multi-flow pump is a radial piston pump having a plurality of axially-spaced cylinder blocks associated with a common pump shaft, each of the cylinder blocks having a plurality of radially-disposed piston-and-cylinder units, and each of the first hydraulic lines is connected to a respective piston-and-cylinder unit.

* * * * *